United States Patent [19]

Lott

[11] Patent Number: 4,991,853

[45] Date of Patent: Feb. 12, 1991

[54] FINANCIAL BOARD GAME APPARATUS

[76] Inventor: Nathaniel E. Lott, 20 Halrs Ct., Westport, Conn. 06880

[21] Appl. No.: 399,023

[22] Filed: Aug. 28, 1989

[51] Int. Cl.[5] ..... A63F 3/00

[52] U.S. Cl. ..... 273/242; 273/278

[58] Field of Search ..... 273/242, 243, 256, 257, 273/278, 279

[56] References Cited

U.S. PATENT DOCUMENTS

| | | | |
|---|---|---|---|
| 1,161,984 | 11/1915 | Scott | 273/278 |
| 3,237,948 | 3/1966 | Murray | 273/256 |
| 3,539,189 | 11/1970 | Shelton | 273/256 |
| 3,799,552 | 3/1974 | Lefevre et al. | 273/256 |
| 3,865,380 | 2/1975 | Thomas | 273/256 |
| 4,150,827 | 4/1979 | Barnett | 273/256 |
| 4,431,195 | 2/1984 | Brand | 273/256 |
| 4,452,457 | 6/1984 | Atieh | 273/256 |
| 4,871,277 | 10/1989 | Mock | 273/278 X |

FOREIGN PATENT DOCUMENTS

| | | | |
|---|---|---|---|
| 297870 | 1/1989 | European Pat. Off. | 273/242 |

*Primary Examiner*—Benjamin Layno

*Assistant Examiner*—William E. Stoll

[57] ABSTRACT

A board game wherein players, in turn, roll dice to determine which company is in play. That player then has the option to buy stock in that company. When a player owns enough stock to be declared chairman of the board, he or she takes posession of the chairman of the board card for that company. Now, in addition to earning dividends on stock held, the player holding the chairman of the board card also earns a quarterly salary and, as chairman of the board, is qualified to take the company to the next level of play thereby increasing the value of the stock, the quarterly dividends, the chairman of the board salary and the quarterly earnings of the company. Whenever another player owns more stock in a company than the current chairman of the board, that player takes posession of the chairman of the board card and is said to have taken over the company, thus, in the course of the game a company may change hands many times. Players encounter event cards that impact companies in play and personal cards that impact players holding chairman of the board cards. The player ending up with the most wealth at the end of the game is declared the winner.

8 Claims, 3 Drawing Sheets

23
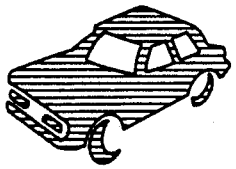
NATIONAL MOTORS
CHAIRMAN OF THE BOARD
FIG. 2
24
QUARTERLY SALARY
| | |
|---|---|
| S/U | 60,000 |
| A | 150,000 |
| AA | 750,000 |
| AAA | 3,000,000 |
FIG. 2A
25
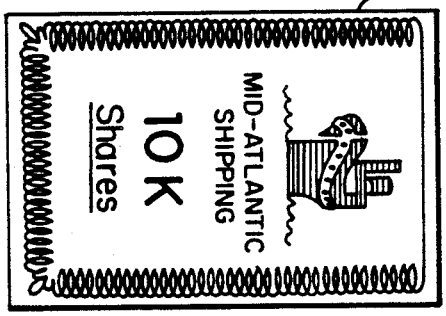
FIG. 3
26
| | VALUE | DIVIDEND |
|---|---|---|
| ST/UP | 30,000 | 6,000 |
| A | 150,000 | 15,000 |
| AA | 750,000 | 75,000 |
| AAA | 3,000,000 | 300,000 |
FIG. 3A
27
JUNK BONDS DEFAULT.
YOU LOSE $ 100,000
FIG. 4
28
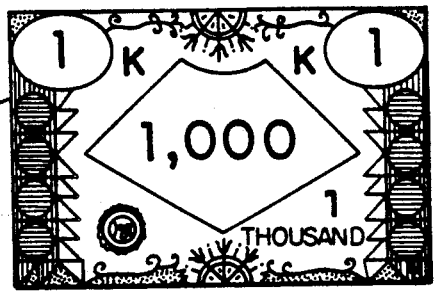
FIG. 5
29
OIL SPILL
40
FIG. 6
30
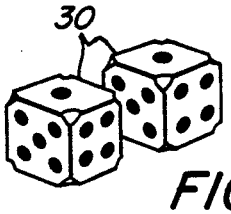
FIG. 7
31
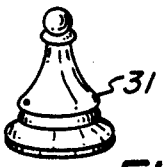
FIG. 8

FINANCIAL BOARD GAME APPARATUS

SUMMARY OF THE INVENTION

The principal object of this invention is to provide a new board game based on a popular financial activity known as "corporate take over", wherein the principal participants in this activity are commonly referred to as "corporate raiders", and whose object is to aquire as much wealth as possible. A further object of this invention is to provide a board game involving the buying and selling of stock, and dealing with the concepts of quarterly earnings, dividens, chairmen of the board and their salaries, corporate takeovers, high interest loans, income taxes and bankruptcy and present these concepts in a simple format so as to be attractive to participants of a young age while at the same time being sufficiently challenging to hold the attention of older players.

To this end, the present invention provides a game board divided into eleven vertical tracks delinieated by alternating shades of color, each track representing one of eleven different companies, each company denoted by one of the eleven number combinations (2 through 12) possible on the throw of a pair of dice. The board provides space at the bottom of each track for stock certificates showing the name of the company and it's company symbol. Space is also provided at the top of each track designed to hold simulated currency representing the cash reserves of each company. The playing field of the board is divided into a grid of ten horizontal rows, said grid being further divided into four major sections, the first section being made up of four horizontal rows; the second section made up of three horizontal rows; the third section two horizontal rows and the fourth section one horizontal row. These sections represent four levels of play. The number of rows in each section represent the minimum numbers of blocks of stock necessary to take control of the aforementioned companies at that particular level of play. The board, in combination with other game pieces, provides a simple visual representation of eleven different companies and the public information necessary to know in order to play the takeover game, namely; the amount of stock available for purchase, the amount of money in the company's cash reserves and the financial level of play at which the company's stock is currently trading. Accessory pieces to the game board consist of ten stock certificates for each company, each certificate representing one block of stock equal to ten thousand shares, the value of each block of stock being proportioned to the probable odds of rolling that company's number on any one roll of the dice; game money in denominations of one thousand, five thousand, ten thousand, fifty thousand, one hundred thousand, five hundred thousand and one million, for use in financial transactions; eleven pawns, one each representing one of the eleven different companies denoted on the game board, said pawns being used to move up and down each company's track, indicating the level of play at which that company's stock is currently trading; a stack of event cards that depict an event that will impact the cash reserves of the company in play; eleven different chairman of the board business cards used to identify the chairman of the board of each of the companies depicted on the game board; a stack of personal cards which depict situations that impact those players holding chairman of the board business cards; a calendar used to indicate the current round of play; a pawn to be used as a marker on said calendar and a pair of dice, all of which will be fully discussed hereinafter.

DESCRIPTION OF DRAWINGS

FIG. 2 is a plan view of the face and reverse side of a typical chairman of the board business card, the face having thereon denoted the name and company symbol of one of the eleven companies designated on the game board; the reverse side denoting the chairman of the board quarterly salary of that particular company at four different levels of play.

FIG. 3 is a plan view of the face and reverse side of a typical stock certificate, the face side denoting the name and company symbol, as well as denoting that the certificate represents ten thousand shares; the reverse side denoting thevalue of said certificate and it's quarterly dividend at four different levels of play.

FIG. 4 is a plan view of a typical personal card denoting thereon one of sixteen different situations that impact players holding chairman of the board business cards whenever said player rolls a double during his or her turn at the dice.

FIG. 5 is a plan view of one of seven different denominations of simulated currency.

FIG. 6 is a plan view of one of forty different event cards that impact the cash reserves of the current company in play, each card denoting thereon an event and a number which represents the percentage value of said impact.

FIG. 7 is an isometric view of a pair of dice used to determine which of the eleven companies depiced on the game board is in play during each players turn.

FIG. 8 is an isometric view of one of twelve typical pawns, eleven to be used as company markers to be moved up and down the track of each company indicating the level of play at which that company's stock is currently priced, the twelfth pawn being used as a marker to be moved across the face of the calendar depicted on the game board indicating the current period of play. When each player has taken a turn at the dice the marker is moved to the next month.

DESCRIPTION OF THE PREFERRED EMBODIMENT

Figure 1:
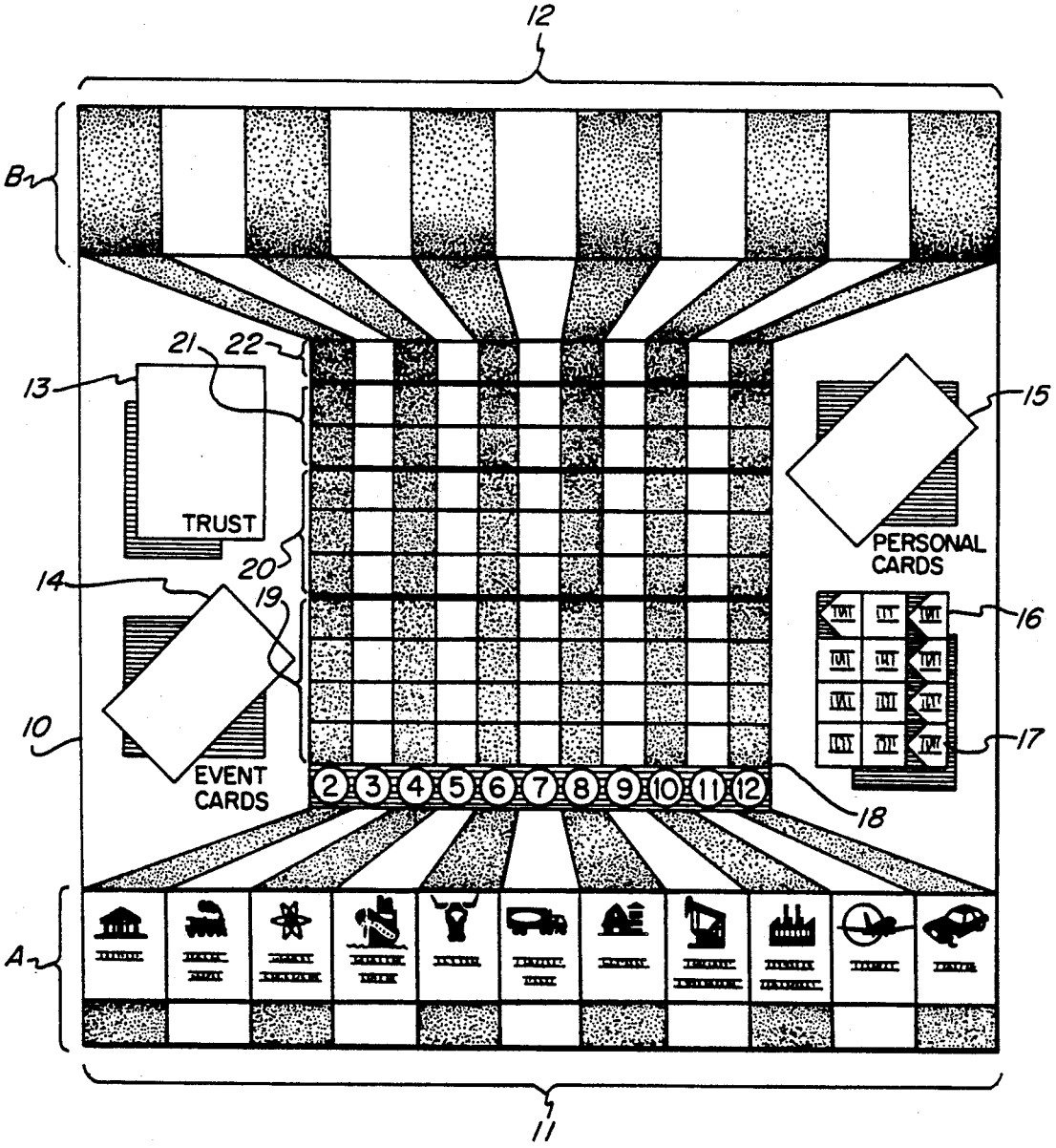
FIG. 1 is a plan view of the game board in accordance with this invention.
Figure 1A:
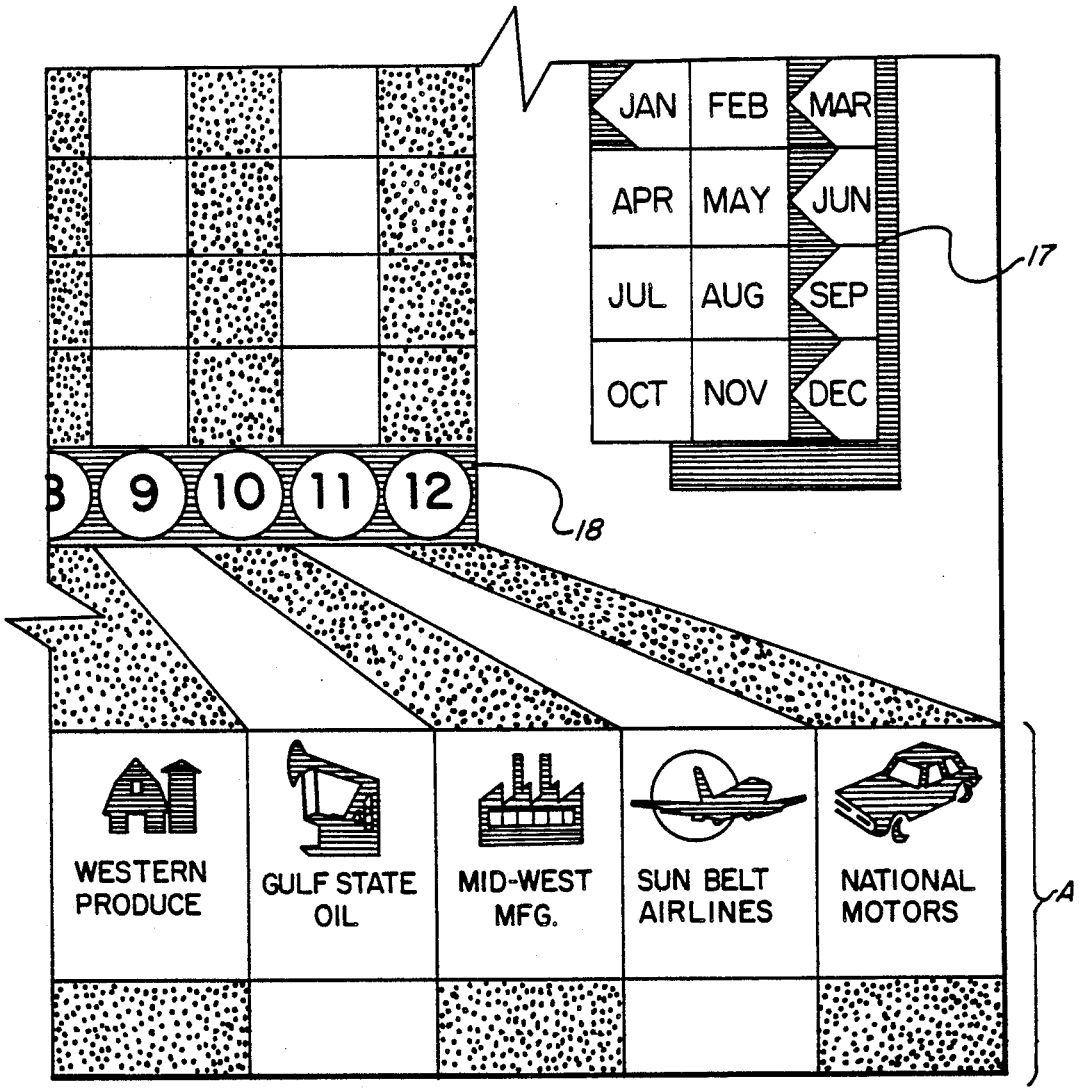
FIG. 1A is an enlarged view of one corner of the game board of FIG. 1

Referring to FIG. 1, reference numeral 10 denotes the game board of this invention, the surface of which is divided into a plurality of tracks delineated by alternating shades of color, said tracks indicated as 11. The total number of tracks on the surface of game board 10 may vary according to the number of dice employed in the play of the game, but for purposes of describing the invention herein, they constitute eleven in number, as shown in FIG. 1. Each track represents one company, the name and company symbol of which is denoted in the space bound by the area on board 10 designated horizontally as 11 and vertically as A. Each company track proceedes across the board 10 through a center grid area designated as 16 ending at the top of the board in spaces designated horizontally as reference numeral 12 and vertically as B. This space is designed to hold each company's cash reserves. The board 10 also depicts two areas at the left of center grid 16, one denoted as "trust", 13, and the other denoted as "event cards", 14. It also depicts two areas at the right of center grid, 16, one denoted as "personal cards", 15, and the other representing a twelve-month calendar, 17. In the area immediately below the center grid, 16, there is a space, 18, which denotes eleven different numerals, each numeral representing the track of one particular company. These numerals range from 2 through 12 and represent the total score possible on one throw of a pair of dice. Again, the plurality of tracks and the range of numbers could vary according to the number of dice employed. Other random number generating means, such as a spinner, might be used, but they must also produce a range of probable odds for each number as the value of each company denoted on board 10 bears a direct relationship to the probability of that company's number coming up, Center grid, 16, of board 10 is made up of ten squares within each company's track. The center grid, 16, is further divided into four horizontal sections representing four levels of play, start up, 19, class A, 20, class AA, 21, and class AAA, 22. There could be any number of levels of play depending on the complexity desired, but for purposes of desciption, this embodiment of the game is limited to four. The first section, the start up level, 19, of each company track, is comprised of four squares, the second section, class A, 20, three squares, the third section, class AA, 21, two squares and the fourth section, class AAA, referrence numeral 22, one square. The number of squares in each section represent the minimum number of stock certificates necessary to take control of the company at that level of play. As accessory pieces to the game board, there are ten stock certificates, FIG. 3, for each company depicted on board 10, each stock certificate denoting the name of the company and it's company symbol, and also denoting that each certificate represents 10,000 shares in that particular company. Ten stock certificates are provided for each company in this version of the game, but the number of stock certificates could vary depending on the complexity desired.

Also included as accessory pieces to the game board, 10, are eleven chairman of the board business cards, FIG. 2, one for each of the eleven companies depicted on board 10; play money, FIG. 5 typical, in denominations of one thousand, five thousand, ten thousand, fifty thousand, one hundred thousand, five hundred thousand and one million; a deck of event cards, FIG. 6; a deck of personal cards, FIG. 4; a pair of dice, FIG. 7; and twelve pawns, FIG. 8. The use and purpose for all these will become clear when we discuss the play of the game.

To initiate play in the game of this invention, the ten stock certificates, FIG. 3, of each company are placed in the coresponding spaces at the bottom of the board, 10, referenced A-11. Currency equal to the start up value of each company, hereafter referred to as company cash reserves, is placed in the corresponding spaces at the top of board 10, referenced 12-B. Total company value is equal to ten times the value of one stock certificate at that level of play — see 26 of FIG. 3. A pawn, 31, for each company is placed in the start up section of center grid, 16, within each company's track. The deck of event cards, 29, is placed face down in the area designated as 14 on board 10. The deck of personal cards, 27, is placed face down in the area designated 15 on board 10. A twelfth pawn, 31, is placed on the Jan month of the calendar, designated 17 on board 10.

One player is selected to act as banker, said banker to handle all financial transactions between player and the bank; the distribution of quarterly dividends and quarterly earnings, chairman of the board salaries, the selling and redemtion of stock certificates, etc. Such person may also participate as one of the players.

At the start of the game each player is given a suitable amount of money, 28. For purposes of describing this embodiment, each player will be receive $300,000.

Order of play is determined by a roll of the dice, 30; high roller first. This order will maintain throughout the game.

The player selected to lead off then rolls the dice, 30, to determine which company, 11-A, is in play. An event card, 29, which will impact this company is turned up. If the player elects to purchase stock in this company, he or she does so by paying the purchase price as indicated on the back of the stock certificate for that level of play, (see 26 of FIG. 3). He or she then takes possession of the number of stock certificates, FIG. 3, representing the total number of shares purchased. If the player purchases enough stock to take control of the company, he or she also takes possession of the chairman of the board card, FIG. 2, in recognition of that control. The player then rolls the dice a second time to determine the impact of the event card. An even number denotes a positive impact and money amounting to a percentage of the total company value is added to the company's cash reserve. An odd number denotes a negative impact and money in the same amount is deducted from the company's cash reserve, 12-B. The percentage value used in this computation is the number denoted on the event card, 29. Play is then passed to the next player and continues in the same manner. If subsequent players purchase and hold more stock than the player currently holding the chairman of the board card, FIG. 2, they take possession of the card and are said to have "taken over" that company. As play progresses, money is added to or deducted from a company's cash reserve, 12-B, by the impact of event cards and the addition of quarterly earnings equal to three times the value of one stock certificate at that level of play as denoted on the reverse side of that company's stock certificate, (see 26 of FIG. 3). The calendar marker is advanced one month when all players have completed one turn at the dice. Quarterly earnings and divdidends (see 26 of FIG. 3) are paid by the bank when the calendar marker is moved onto the months of Mar, June, Sept and Dec. When there are sufficient funds in a company's cach reserve, the chairman of the board may elect to take the company to the next level of play. The chairman of the board does this by purchasing any unsold stock with funds from the company's cash reserve. The chairman must also redeem any stock held in excess of the minimum necessary to retain control of the comany at the new level of play. All shareholders holding stock in this company must redeem, at maximum, the same number of shares as the chairman of the board. The redemtion value of all stock so redeemed is fifty percent of the face value at the new level of play. Thus, anyone holding stock in this company has made a tidy profit. The company marker, pawn 31, for this company is then moved to the next level of play, (see 19 through 22 of FIG. 1). The company's stock now trades at the higher price, as denoted on the on the back of stock certificate 26, for this level of play. Thus, by the act of reorganizing the company and moving it to the next level of play, the chairman of the board has increased his or her quarterly salary, (see 24 of FIG. 2), and has increased the value of his or her stock, but, since at the new level of play he or she owns less stock than before, the company is more vulnerable to takeover by another player. With this in mind, instead of reorganizing the company, as described above, the chairman of the board may elect to try to increase his or her holdings until he or she owns fifty percent of the stock in a company, at which time he or she may elect to "cash out" by selling the company back to the bank in exchange for all the money in the company's cash reserve. Any other stockholder holding shares in a company that has been sold back to the bank, will share in the company's cash reserve proportional to his or her holdings. The fortunes of players holding chairman of the board cards are further impacted by the play of personal cards, (see 27 of FIG. 4). A personal card can only be brought into play when a player holding a chairman of the board card rolls a double on any roll of the dice. The impact of these cards can be very rewarding or very damaging. Thus, a player holding a chairman of the board card can never claim victory until the last play of the game. As the object of the game is to garner as much wealth as possible and as play can go on for many hours and possibly days, a time limit should be established before play begins, with play ending when the last player has had his or her roll of the dice.

There are other aspects of the game that can affect the outcome, namely:

Loans—A chairman of the board may borrow from the bank to finance a reorganization. When a company owes money to the bank, all quarterly earnings and dividends must go to satisfy the loan. However, the chairman of the board's salary is not affected.

Players may borrow to finance stock purchases.

Interest on all loans is 10% per calendar month. All loans must be refinanced after three consecutive months.

All loans must be backed by collateral. A company's loan value, plus interest, must not exceed fifty percent of it's total value at the current level of play. In the event a company's outstanding debt exceeds it's loan limit, the company is declared bankrupt and all outstanding stock is turned over to the bank. Play on that company's stock will begin again at the start up level.

Players receive no payment for stock when a company goes bankrupt.

Players may redeem stock of a company in debt, but must do so at their turn of the dice, prior to any other transaction.

A players loan value, plus interest, must not exceed the redemption value of all stock held. In the event a players loan value exceeds his or her loan limit, the player is declared bankrupt and is out of the game, and all assets are turned over to the bank.

All loans are documented on paper, said paper being placed in "trust", reference 13 on board 10.

Income Taxes—Play begins with the calendar marker on Jan. After twelve months of play, players and companies are required to pay income taxes. Players pay a flat ten percent of cash on hand. Companies pay ten percent of total value at the current level of play.

Personal income taxes may be considered an option of play, but must be decided upon before play begins.

Player Stock Sales and Redemptions—Players may buy and sell stock between themselves at any time and any price. All such transactions must be announced at the next turn of either party involved. Failure to do so will void the transaction. All transactions become official on either players next turn.

A player may redeem stock at fifty percent of face value. This can be done at any time during the players turn at the dice.

The game may be played by any number of participants but is best suited to four to six players. Coupled can play as teams, each player taking a turn at the dice and the team sharing all assests. When a large number of players are present, players may elect to limit stock purchases to one block of stock on any turn at the dice.

What is claimed is:

1. A board game for two or more players comprising;

(A) a game board having delineated theron a plurality of tracks each track bearing a different number each number representing a different company, said companies names and company symbols being denoted in adjacent rectangular spaces along one edge of saidgame board;

(B) said rectangular spaces being an integral part of said tracks said tracks proceeding across said game board to the opposite edge ending in adjacent rectangular spaces along said opposite edge of said game board said rectangular spaces along said opposite edge being an itegral part of said tracks;

(C) said game further comprising a plurality of stock certificates for each company denoted on said game board the face of each of said stock certificate denoting thereon the name and company symbol of the company so represented, the reverse side of each of said stock certificate bearing indicia representing the value and quarterly dividend of said stock certificate at various levels of play;

(D) a plurality of chairman of the board business cards, one each of said business cards representing one of said companies denoted on said game board, the face of said business card denoting thereon the name and company symbol of the company so represented, the reverse side of said business card bearing indicia representing the quarterly salary of the chairman of the board at various levels of play, (E) a deck of personal cards each card having denoted thereon a situation that will impact the player holding said chairman of the board business cards (F) a deck of event cards each card having denoted thereon an event and a percentage value that will impact the current company in play;

(G) a plurality of simulated currency to be used to conduct various financial transactions;

(H) two or more dice; and (I) a plurality of pawns.

2. A game as claimed in claim 1 wherein said game board has further delineated thereon a track divided into twelve spaces said spaces representing twelve periods of play over which one of said plurality of pawns is moved one space and on which said spaces one of said plurality of pawns is brought to rest when said space one of said plurality of pawns is brought to rest when all players have had one turn of play.

3. A game as claimed in claim 2 wherein one each twelve spaces of said track has delineated thereon one of the months of the year, January through December, each month representing one round of play by all players, the months of March, June, September and December bearing indicia representing quarterly periods at which time quarterly earnings, dividends and quarterly salaries are distributed and the month of January bearing indicia representing the period when income taxes are paid.

4. A game as claimed in claim 3 wherein the center portion of the company tracks deliniated on said game board are divided into a plurality of sections each section representing a different level of play each succeeding level of play representing an increase in the value of stock, quarterly divideds, chairman of the board quarterly salaries and company quarterly earnings, said levels of play being marked for each company by one each of said plurality of pawns.

5. A game as claimed in claim 1 wherein the center portion of the company tracks deliniated on said game board are divided into a plurality of sections each section representing a different level of play each succeeding level of play representing an increase in the value of stock, quarterly divideds, chairman of the board quarterly salaries and company quarterly earnings, said levels of play being marked for each company by one each of said plurality of pawns.

6. A game as claimed in claim 1 wherein the numerical indicia denoted on said game board representing one each of the plurality of companies denoted thereon correspond to the numerical indicia possible on the throw of two or more dice the value of said companies being governed by the probable odds of rolling that number on one throw of said dice, rare numbers having a higher value, common numbers having a lower value.

7. A game as claimed in claim 6 wherein the center portion of the company tracks deliniated on said game board are divided into a plurality of sections each section representing a different level of play each succeeding level of play representing an increase in the value of stock, quarterly divideds, chairman of the board quarterly salaries and company quarterly earnings, said levels of play being marked for each company by one each of said plurality of pawns.

8. The game of claim 1 wherein each of said stock certificates represent an equal percentage of the company they represent, said percentage being equal in all of said stock certificates thus making the value of said stock certificate the basis for all corporate percentage calculations such as event card impacts, corporate quarterly earnings and corporate income taxes.

* * * * *